United States Patent [19]

Scholle et al.

[11] Patent Number: 4,458,734

[45] Date of Patent: Jul. 10, 1984

[54] APPARATUS AND METHOD FOR ASEPTICALLY FILLING A CONTAINER

[75] Inventors: William J. Scholle, Irvine; William Lloyd-Davies, South Laguna, both of Calif.

[73] Assignee: Scholle Corporation, Calif.

[21] Appl. No.: 343,918

[22] Filed: Jan. 29, 1982

[51] Int. Cl.[3] ..... B65B 31/02

[52] U.S. Cl. ..... 141/5; 141/51; 141/92; 53/88; 53/109; 99/474; 422/219; 426/399

[58] Field of Search ..... 99/474; 422/219; 53/88, 53/109, 426; 426/399, 400, 401; 141/1-12, 37-68, 85-92, 114, 69, 70, 100, 285-310, 372

[56] References Cited

U.S. PATENT DOCUMENTS

| | | | |
|---|---|---|---|
| 1,770,379 | 7/1930 | Young . | |
| 2,108,216 | 2/1938 | Stringer . | |
| 2,649,671 | 8/1953 | Bartelt . | |
| 2,787,875 | 4/1957 | Johnson . | |
| 2,930,170 | 3/1960 | Holsman et al. . | |
| 2,972,214 | 2/1961 | Juin . | |
| 2,974,456 | 3/1961 | Parodi | 53/88 |
| 3,026,791 | 3/1962 | Wegener | 99/356 |
| 3,052,269 | 9/1962 | Manas | 141/114 |
| 3,191,640 | 6/1965 | Hackett | 141/63 |
| 3,340,671 | 9/1967 | Loo . | |
| 3,403,826 | 10/1968 | Buford et al. | 141/114 |
| 3,438,790 | 4/1969 | Barnby . | |
| 3,486,295 | 12/1969 | Rausing et al. . | |
| 3,605,826 | 9/1971 | Carter | 141/5 |
| 3,765,142 | 10/1973 | Lindquist et al. | 141/91 |
| 3,866,474 | 2/1975 | Hasselmann | 141/67 |
| 3,977,445 | 8/1976 | White | 141/5 |
| 4,256,150 | 3/1981 | Möckesch | 141/5 |
| 4,273,263 | 6/1981 | Voegele et al. | 222/148 |
| 4,363,338 | 12/1982 | Brown | 141/5 |

*Primary Examiner*—Houston S. Bell, Jr.
*Attorney, Agent, or Firm*—Knobbe, Martens

[57] ABSTRACT

A device for filling containers through a spout on the container includes a sterile chamber that has an opening in a wall through which the spout of the container may be inserted into the chamber, a filling head inside the chamber for connecting with the spout and filling the container through the spout, a cup-shaped cap inside the chamber that covers the opening in the wall to substantially prevent the escape of a sterile gas from the chamber when the spout is not in the opening, a fluid spray head inside the cup-shaped cap for sterilizing the spout before it is exposed to the sterile chamber, and a pair of jaws that fit around the spout when the spout is in the opening to substantially prevent the escape of the sterile gas during the filing operation when the cap is removed.

23 Claims, 5 Drawing Figures

Fig. 1
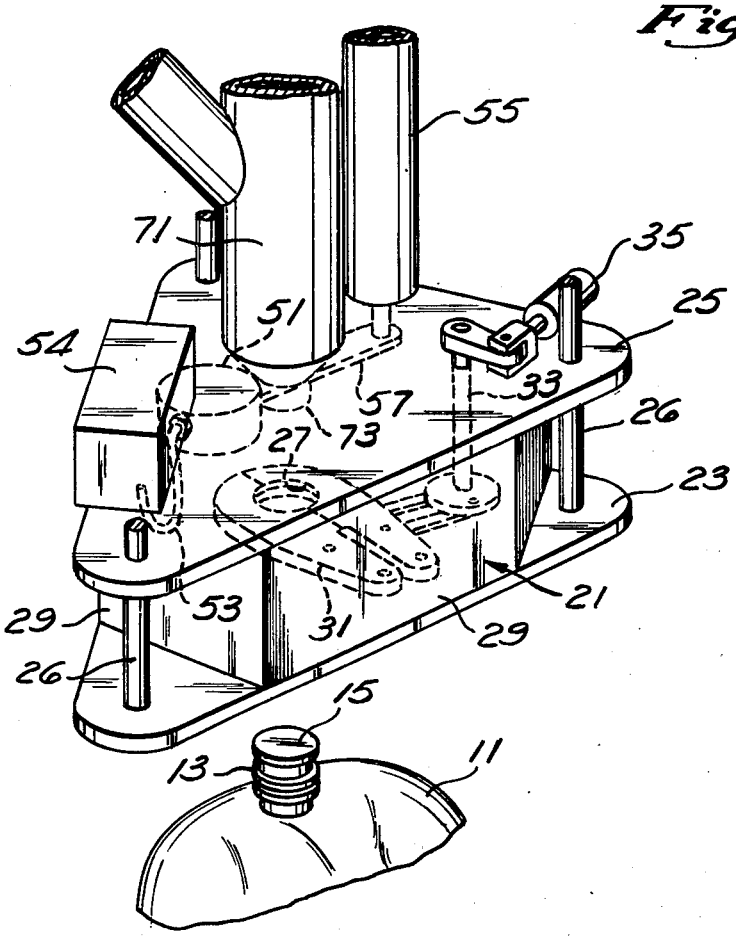
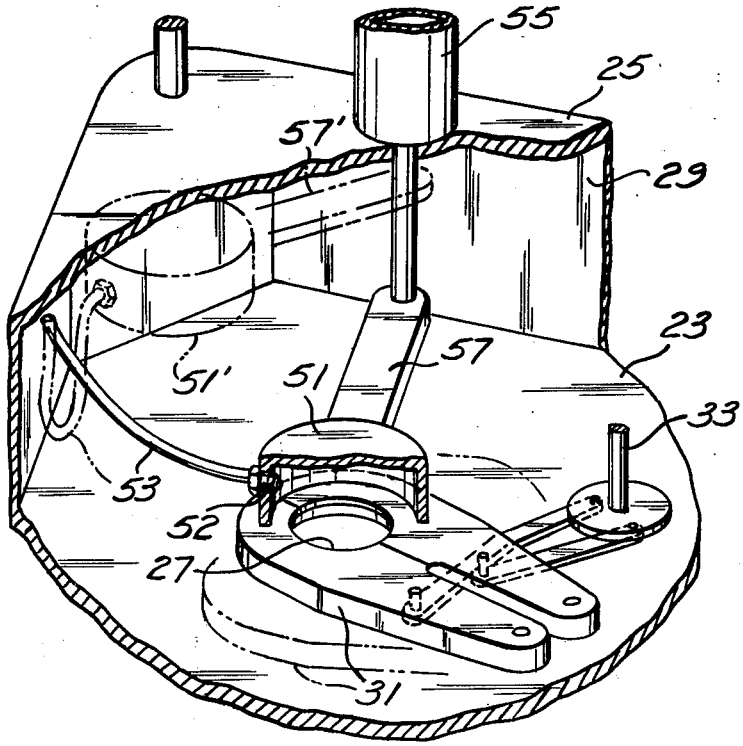
Fig. 2

Fig. 3a
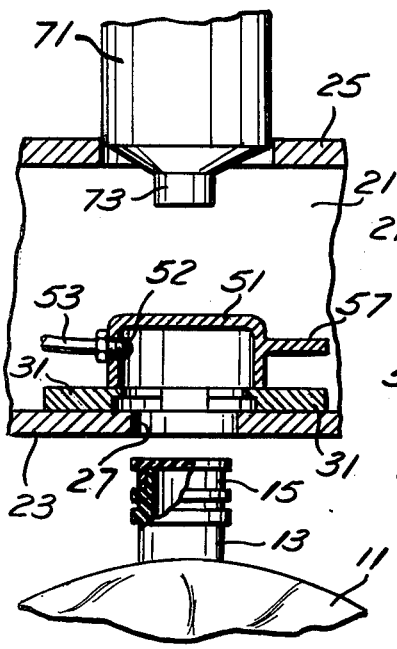
Fig. 3b
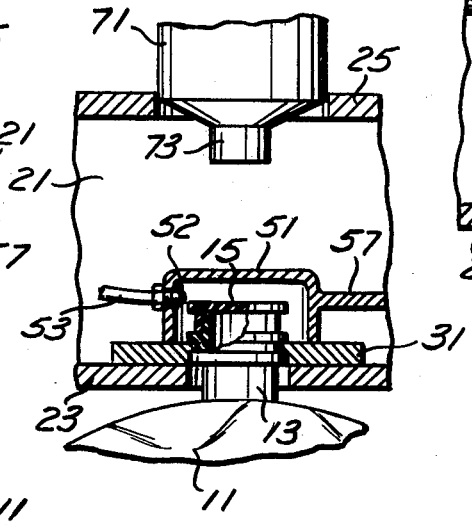
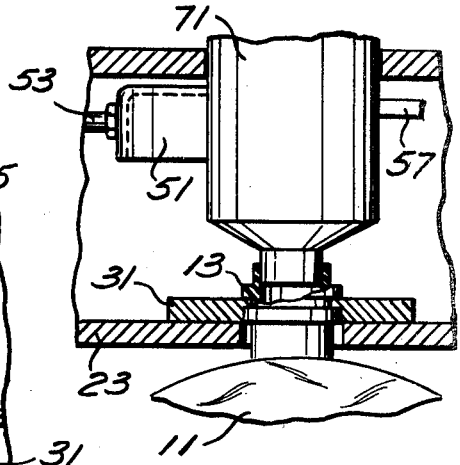
Fig. 3c

APPARATUS AND METHOD FOR ASEPTICALLY FILLING A CONTAINER

BACKGROUND OF THE INVENTION

Many liquid and semi-liquid products are packaged into large containers for storage and distribution to repackagers, commercial users and other users of large quantities of the product. Many of the these products, particularly food products, deteriorate rapidly when exposed to oxygen. Additionally, food products must be protected against possible contamination from bacteria. Therefore, these products are often placed in large (five gallon) bags made of plastic or similar material and having one spout through which the bag is filled and from which the product is dispensed from the bag. These plastic bags are advantageous in that as the product is dispensed from the container, the bag collapses around the remaining material so that no air enters the container. With containers of a fixed shape or internal volume, air must enter the container to fill the volume left in the container as the product is dispensed. This air contains oxygen and frequently carries harmful bacteria. These containers typically have a rigid or semi-rigid plastic spout through which the product passes to enter or leave the container.

Care must be taken in packaging food products into the containers that no bacteria that would create a potential health risk to the consumer of the food product enter the container. To ensure this sterility, the containers are filled using a chamber that maintains a sterile atmosphere around the spout of the container. Typically, a sterile chamber is filled with a sterile gas, with the gas maintained in the chamber at a positive pressure with respect to the outside environment. The positive pressure of the gas ensures that no air from outside the chamber enters the chamber, as the flow through any opening in the chamber walls is from the higher pressure interior to the lower pressure exterior. A filling head is provided inside the chamber for filling the container with the product. An opening is then provided in the bottom of this chamber that is just large enough to receive the spout of one of the plastic bag food containers. Once the spout is placed in the opening, it is brought into contact with the filling head and the product is dispensed into the bag.

Because of the positive pressure maintained in the chamber, a substantial amount of the gas escapes through the opening, particularly between filling operations after the spout of one container has been removed from the opening and before another has replaced it. Additionally, since the opening must be slightly larger than the spout of the containers, when the spout is in the opening, the gap between the spout and the rim of the opening permits the gas inside the chamber to escape to te outside environment. Because such a large amount of the sterile gas is lost in this way, a number of problems have existed. One of these problems is that only a relatively inexpensive gas can be practically used in the chamber. This has effectively limited the choice of gases to just one gas: hot sterile air. However, use of sterile air, which contains oxygen, exposes the food product to oxygen during the filling operation, which reduces the shelf life of the food product. Also, since the sterile gas must be kept hot to ensure continued sterility of the chamber, large volumes of the gas must be heated. This heating consumes a large amount of energy and requires the use of a considerable amount of equipment.

Thus, a need has existed for an apparatus for filling food containers that uses only a small amount of sterile gas, so that an inert gas could be used as the sterile gas to increase the shelf life of the product being packaged, and so that the heating requirements for the gas could be substantially reduced.

SUMMARY OF THE INVENTION

An enclosed chamber has an opening (large enough to receive the end of a conduit for conducting material, such as the spout of a flexible container) in one side, preferrably the bottom. The chamber is provided with a hot sterile gas at a positive pressure with respect to the outside environment. The gas is preferably an inert gas, such as nitrogen. A material dispensing nozzle suitable for connecting with the conduit is located in the chamber. A pair of jaws are pivotally mounted on the bottom of the chamber to clamp the conduit in position in the opening of the chamber and hold it during the dispensing operation. A small cup-shaped cap is disposed in an inverted position inside the chamber on top of the jaws to cover the opening and substantially prevent the flow of the sterile gas through the opening.

In use, after the chamber has been sterilized and supplied with the sterile gas at a positive pressure, the cap is placed over the opening. Thus, virtually all of the sterile gas remains in the chamber. The conduit is inserted into the opening under the cap. The jaws are pivoted closed so that they clamp around the conduit and substantially prevent the passage of any gas or air through the opening around the conduit. After this conduit has been placed in the opening, it is sprayed with a sterilizing fluid, such as an atomized hot liquid chlorine solution, to eliminate any bacteria that may be on it or on the inside of the cup-shaped cap. After this sterilization, the cap, or cover, is lifted and pivoted out of the way inside the sterile chamber. The cap on the conduit is removed. The chamber with the conduit attached is moved upward while the filling nozzle is kept stationary to bring the conduit into contact with the filling nozzle. The product is then dispensed through the filling nozzle and through the conduit.

After the dispensing is complete, the chamber, with the conduit attached, is lowered again to its initial position, the conduit cap is replaced in the conduit, and the cup-shaped cap is replaced over the spout and the opening. The jaws holding the conduit in place are released and the conduit is removed. Before another conduit is placed in the opening, the inverted cup placed over the opening ensures that only a minimal amount of the sterile gas inside the chamber escapes to the environment.

During the entire operation, the positive pressure of sterile gas in the chamber ensures that the chamber remains sterile and free of any contamination. Should there be any leaks in the opening around the jaws or the conduit, or under the cup-shaped cap, the sterile gas will escape to the outside environment, and outside air and bacteria will be prevented from entering the sterile chamber. But, because the opening is substantially closed off, the loss of sterile gas is minimal.

BRIEF DESCRIPTION OF THE DRAWINGS

FIG. 1 is a perspective view of the filling apparatus herein disclosed.

FIG. 2 is a cut-away perspective view of the filling apparatus.

FIGS. 3*a*, 3*b*, and 3*c* are cross-sectional views of the filling apparatus showing the apparatus at different stages of operation.

DETAILED DESCRIPTION OF THE PREFERRED EMBODIMENT

The Apparatus

The filling apparatus of the present invention shown in FIG. 1 includes a sterile chamber 21, defined by top plate 25, bottom plate 23, and walls 29. Filling tube 71 passes through an opening in the top plate 25 of the chamber 21. Filling tube 71 conducts a product, such as a liquid or viscous material, from a source to nozzle 73. A filling tube that is well suited for use as filling tube 71 is the device disclosed in U.S. Pat. No. 3,926,229, issued to William R. Scholle and assigned to the Scholle Corporation.

A container 11, which is to be filled with a product by the apparatus of the present invention, is preferably constructed of a flexible material, such as plastic. The container 11 has a filling spout 13, sealed by a removable cap 15. Opening 27 in bottom plate 23 is slightly larger than the spout 13. The filling spout 13 of the container 11 is used hereinafter as representative of the product conduits with which the apparatus can be used.

Posts 26, which are firmly attached to top plate 25 and bottom plate 23, are coupled to a mechanism (not shown) for selectively raising and lowering chamber 21. When chamber 21 is moved, the filling tube 71 does not move. Rather, top plate 25 slides along the outer surface of filling tube 71 as chamber 21 is raised and lowered. Chamber 21 is movable between an upper position, in which bottom plate 23 is adjacent nozzle 73, and a lower position (shown), in which upper plate 25 is adjacent nozzle 73.

Cup-shaped cap 51 is disposed in an inverted position inside the chamber and is attached to arm 57, which pivots on a shaft leading from control mechanism 55. Cap 51 has a diameter slightly larger than the diameter of the opening 27 in the bottom plate 23 of the chamber 21.

Fluid line 53 connects the interior of cup-shaped cap 51 with a source 54 of sterilizing fluid, such as a liquid chlorine solution. Source 54 controls the flow of the sterilizing fluid so that the fluid may be selectively allowed to flow through line 53 into the interior of cap 51 to sterilize the interior of the cap. Source 54 also includes a heater for the sterilizing fluid.

Connected pivotally to the bottom plate 23 of the chamber 21 are jaws 31. They may be pivoted between a closed position (shown) and an open position by rotation of shaft 33, which is connected to control mechanism 35. These jaws 31 are shaped so that when they are in the closed position they just fit around the spout or neck 13 of the container. Jaws 31 open sufficiently to permit entry of spout 13 of the container 11.

FIG. 2 shows in greater detail the mechanisms inside chamber 21. Cup-shaped cap 51 is shown in two positions. In the first of these positions, indicated by the solid lines and the reference numeral 51, the cap rests on jaws 31 to cover opening 27. When the cap is in this position, the interior of the cup defines a small compartment that communicates through opening 27 with the outside environment. But the remainder of the interior of the chamber 21 is kept virtually isolated from the outside environment. The second position of the cup-shaped cap is indicated by the phantom lines and the reference numeral 51'. In this position, the cap is removed from the vicinity of the opening 27. When the cap is in this position, opening 27 is uncovered and there is free communication between the interior of the chamber 21 and the outside environment. Control mechanism 55 coupled to arm 57 governs the movement of the cap 51 between these positions.

Also shown in FIG. 2 is nozzle 52 inside cap 51. This nozzle 52 is suitable for spraying a hot sterilizing fluid, such as a chlorine solution, from source 54 into the interior of cap 51.

Jaws 31 pivot between the closed position indicated by the primary lines and the open position indicated by the phantom lines in FIG. 2. This pivoting is controlled by rotation of shaft 33. Jaws 31 may be pivoted between their open and closed positions with cap 51 in its second position, resting on the jaws 31.

Attached to the outside of wall 29 (FIG. 2) is a heater (not shown) that is capable of heating the interior of chamber 21.

Operation of the Apparatus

The apparatus is shown in its initial state in FIG. 3*a*. The cap 51 is in its first position, resting on jaws 31, which are in their open position. The small area under the cap 51 is open to the outside environment through opening 27, while cap 51 virtually seals the remainder of the chamber from the outside environment. Chamber 21 is in its lower position, with upper plate 25 adjacent nozzle 73. The interior of the chamber, except for the compartment under the cap 51, is supplied with a sterile gas. This gas is preferrably a gas that contains no oxygen to maximize the shelf life of the product being packaged into the container 11, and is ideally an inert gas such as nitrogen. The gas is supplied to the chamber in a sufficient quantity that the pressure inside chamber 21 is greater than that of the environment outside the chamber. This positive pressure ensures that if there are any leaks around filling tube 71 or between the cap 51 and the jaws 31, or between the jaws 31 and the bottom plate 23, the gas from inside chamber 21 will escape to the outside environment. This prevents the air from outside the chamber, with the bacteria it may contain, from entering the sterile chamber, and preserves the sterility of the chamber.

A container 11, such as a flexible plastic bag, having a spout 13, has previously been sterilized and sealed with cap 15, which prevents air and bacteria from entering.

Container 11 is brought near the bottom plate 23 of the chamber 21 and its spout 13 is placed into opening 27. Any contamination that is on the spout 13 when it is placed in the opening 27 does not enter the sterile chamber 21 because of cap 51. Jaws 31 are then closed around the spout 13, as shown in FIG. 3*b*. The jaws 31 hold spout 13 in place in the opening 27 and also effectively prevent the flow of any gas between the compartment under the cup-shaped cover 51 and the outside environment. A sterilizing fluid, such as a solution of chlorine from source 54 (FIG. 1), is directed through fluid line 53 and sprayed into the interior of the compartment under cover 51 through nozzle 52. This fluid sterilizes the interior of the compartment under cap 51 and also sterilizes the exterior of the container spout 13 and the container cap 15. After the container spout 13 and the container cap 15 have been sterilized, the cover 51 is moved up and away from the opening 27 to a position substantially as shown in FIG. 1, thus unifying chamber 21. Since the interior of the compartment and the spout 13 have been sterilized, and jaws 31 are closed around spout 13, no contaminants enter chamber 21 when the cover 51 is moved away from opening 27. The cap 15 of the container is removed from the spout 13 so that communication is established between the interior of sterile chamber 21 and the interior of the sterile container 11. Mechanical means for removing cap 15 from spout 13 are well known in the food packaging industry, and inclusion of such means in the drawings would unduly complicate the drawings; therefore, the mechanism for removing cap 15 from spout 13 is not shown in the drawings. The jaws 31, which are closed around the spout 13, virtually seal chamber 21 from the outside environment. Nevertheless, the positive pressure of gas in the chamber ensures that any leaks will result in sterile gas leaving the chamber, preventing outside air and the bacteria it may carry from entering the chamber.

The chamber is then moved upward, sliding along the outside of filling tube 71, until the nozzle 73 of filling tube 71 comes into contact with the spout 13 of the container 11, as shown in FIG. 3*c*. The product with which container 11 is to be filled is dispensed from filling tube 71, through nozzle 73 and spout 13, and into container 11.

After the container 11 has been filled, chamber 21 is lowered again to its initial position and container cap 15 is again placed on spout 13 to seal the container 11. The cover 51 is again placed on top of jaws 31 to form a small compartment over the spout 13 as shown in FIG. 3*b*. Because cover 51 is in place over opening 27, when jaws 31 are opened no contamination from outside enters the chamber. The jaws 31 are then opened and the spout 13 is removed from the opening 27. The apparatus is then ready to receive another container.

During the entire operation, sterility of the chamber is ensured by the positive pressure of sterile gas maintained inside the chamber 21. Any leaks in the chamber will result in an outflow of gas, rather than an inflow of outside air and bacteria. Nevertheless, since opening 27 is virtually sealed during the entire operation of the apparatus, either by cover 51, which allows only a small compartment of the chamber to communicate with the outside environment through opening 27, or by jaws 31 closed around spout 13 to prevent virtually all communication between the interior of chamber 21 and the outside environment. Thus, only a small amount of the sterile gas escapes from the chamber during the operation of the apparatus.

Additionally, the gas in the chamber 21 is kept heated by the heater (not shown) on a wall 29 of the chamber (see FIG. 2). The heating requirements are not great, as the only heat losses are by thermal conductivity through bottom plate 23, top plate 25, and walls 29, and by the loss of hot gas through leaks in the chamber, which are kept small by the present invention.

We claim:

1. A method of aseptically filling a container with a product using filling apparatus in a sterile chamber having an opening in a chamber wall providing communication between said chamber and the outside environment, comprising:

dividing said chamber into first and second compartments by providing a cover means over said opening, said first compartment having said opening for communication with the outside environment;

supplying said second compartment with a sterile gas at a positive pressure with respect to the outside environment;

placing the spout of a container to be filled in said opening;

closing said opening around said spout so that said first compartment is closed off from the outside environment;

sterilizing said spout and said first compartment;

uniting said first and second compartments so that said sterile gas fills all of said chamber at a positive pressure with respect to the outside environment;

filling said container with said product through said spout;

redividing said chamber into said first and second compartments; and removing said spout from said opening.

2. The method of claim 1, wherein said step of dividing said chamber into said first and second compartments comprises:

placing a cup-shaped cap over said opening on the inside of said chamber so that said first compartment comprises the space inside of said cup-shaped cap.

3. The method defined in claim 1, wherein said step of sterilizing said spout and said first compartment comprises:

spraying a sterilizing fluid into said first compartment.

4. The method of claim 1, wherein said container is provided with a cap that seals said spout, the method additionally comprising the steps of:

removing said cap after placing said spout in said opening, but before filling said container; and replacing said cap after filling said container to seal said spout before removing said spout from said opening.

5. In a device for dispensing a product, comprising an enclosed chamber having an opening in a wall thereof for communication with the outside environment, means for supplying said chamber with a fluid at a positive pressure with respect to the outside environment, and means for conducting said product into said chamber, apparatus comprising:

a cover inside said chamber positionable over said opening to substantially prevent said communication through said opening and selectively movable to a different position inside said chamber.

6. The apparatus defined in claim 5, wherein:

said means for conducting said product into said chamber is adapted to fill a container with a spout providing communication with the interior of said container;

said opening is adapted to receive said spout;

said means for conducting said product into said chamber is adapted to fill said container through said spout when said spout is in said opening.

7. The apparatus defined in claim 6, additionally comprising means for closing said opening around said spout to at least substantially reduce the flow of said sterile gas through said opening around said spout.

8. The apparatus defined in claim 7, wherein said means for closing said opening around said spout comprises:

a pair of movable jaws adapted to fit around the perimeter of said spout.

9. The apparatus defined in claim 6, additionally comprising means for sterilizing said spout when said spout is in said opening.

10. The apparatus defined in claim 9, wherein said means for sterilizing said spout comprises:

means for spraying a sterilizing fluid onto said spout;

valve means for controlling said spray;

a heater for heating said sterilizing fluid;

a source of said sterilizing fluid; and conduit means for providing fluid communication between said source of said sterilizing fluid and said means for spraying said fluid.

11. The apparatus defined in claim 5, wherein said cover comprises means forming a compartment in said chamber wherein:

said compartment has dimensions somewhat greater than the dimensions of said opening so that said opening provides communication between said compartment and the outside environment;

said means is movable between a first position in which said means fits over said opening so that said compartment communicates through said opening with the outside environment and a second position in which said means is removed from said opening so that said means for conducting said product into said chamber can conduct said material through said opening.

12. The apparatus defined in claim 11, additionally comprising:

nozzle means for spraying a sterilizing fluid into said compartment.

13. The apparatus defined in claim 6, additionally comprising:

means for heating said sterile gas, said means coupled to a wall of said chamber.

14. In a device for aseptically filling a container having a spout, comprising an enclosed chamber having an opening in a side adapted to receive the spout of said container, filling apparatus for filling said container through said spout when said spout is in said opening, wherein said chamber is supplied with a sterile gas at a pressure above that of the outside environment, the apparatus comprising:

means for selectively dividing said chamber into first and second compartments by covering said opening so that said opening provides communication between said first compartment and the outside environment and said second compartment is supplied with said sterile gas at a positive pressure.

15. The apparatus defined in claim 14, additionally comprising:

means for at least substantially closing said opening around said spout when said spout is in said opening.

16. The apparatus defined in claim 14, wherein said means for dividing said chamber into said first and second compartments comprises:

a cup-shaped covering that is movable between a first position in which said covering fits over said opening on the inside of said chamber so that said first compartment comprises the space inside of said cup-shaped covering, and a second position in which said covering is removed away from said opening.

17. The apparatus defined in claim 14, additionally comprising means for heating said sterile gas, said means coupled to a wall of said chamber.

18. The apparatus defined in claim 14, additionally comprising:

means for sterilizing said first compartment and said spout when said spout is in said opening.

19. An improved method of dispensing a product using an apparatus comprising a chamber having an opening in a wall providing communication between said chamber and the outside environment, the method comprising;

supplying said chamber with a fluid at a positive pressure with respect to the outside environment;

covering said opening to prevent at least a substantial amount of said fluid from leaving said chamber through said opening;

placing a conduit for said product adjacent said opening in position to receive said product when said opening is uncovered;

uncovering said opening;

dispensing said product through said conduit in said opening;

covering said opening; and removing said conduit from said opening.

20. The method defined in claim 19, additionally comprising the step of:

sterilizing said conduit after placing said conduit adjacent said opening.

21. The method defined in claim 20, wherein:

said opening is kept covered while said conduit is placed adjacent said opening;

said opening is kept covered while said conduit is sterilized;

said opening is uncovered after said conduit is sterilized.

22. The method defined in claim 19, wherein placing said conduit adjacent said opening comprises placing said conduit in said opening, additionally comprising the step of:

closing said opening around said conduit after said conduit has been placed in said opening to prevent at least a substantial amount of said fluid from leaving said chamber through said opening around said conduit.

23. The method defined in claim 19, wherein:

said conduit is a spout communicating with a container;

said step of placing said conduit adjacent said opening comprises placing said spout adjacent said opening; and said step of dispensing said product comprises filling said container through said spout.

* * * * *